US006335674B1

(12) United States Patent
Huang

(10) Patent No.: US 6,335,674 B1
(45) Date of Patent: Jan. 1, 2002

(54) CIRCUIT BREAKER WITH A PUSH BUTTON

(76) Inventor: Chao-Tai Huang, No. 210-1, Hsin-Nung Rd., Tou-Liu City, Yunlin Hsien (TW)

( * ) Notice: Subject to any disclaimer, the term of this patent is extended or adjusted under 35 U.S.C. 154(b) by 0 days.

(21) Appl. No.: 09/511,483

(22) Filed: Feb. 23, 2000

(51) Int. Cl.[7] ..... H01H 37/02; H01H 37/32; H01H 37/46

(52) U.S. Cl. ..... 337/37; 337/39; 337/59; 337/85; 337/112; 337/113; 337/66; 337/74

(58) Field of Search ..... 337/379, 79, 59, 337/66, 76, 53, 67–69, 74, 75, 91, 39, 85, 112, 113, 140, 334, 335; 200/553–557

(56) References Cited

U.S. PATENT DOCUMENTS

| | | | | | |
|---|---|---|---|---|---|
| 4,654,487 | A | * | 3/1987 | Sawada | 200/1 V |
| 4,740,661 | A | * | 4/1988 | Nishikawa et al. | 200/68.2 |
| 4,803,317 | A | * | 2/1989 | Sutoh et al. | 200/438 |
| 4,978,823 | A | * | 12/1990 | Sato et al. | 200/437 |
| 5,012,495 | A | * | 4/1991 | Munroe et al. | 337/3 |
| 5,079,530 | A | * | 1/1992 | Tsuchiyama | 335/17 |
| 5,262,748 | A | * | 11/1993 | Tsung-Mou | 337/66 |
| 5,285,039 | A | * | 2/1994 | Satoh | 200/563 |
| 5,293,507 | A | * | 3/1994 | Hayakawa | 200/244 |
| 5,508,485 | A | * | 4/1996 | Nishikawa | 200/525 |
| 5,539,371 | A | * | 7/1996 | Yu | 337/66 |
| 5,694,106 | A | * | 12/1997 | Wang | 337/79 |
| 5,743,382 | A | * | 4/1998 | Luo | 200/315 |
| 5,828,284 | A | * | 10/1998 | Huang | 337/37 |
| 5,933,069 | A | * | 9/1999 | Huang | 337/66 |
| 6,249,209 | B1 | * | 6/2001 | Yu | 337/37 |
| 6,252,489 | B1 | * | 6/2001 | Chen | 337/37 |

FOREIGN PATENT DOCUMENTS

| | | | | | |
|---|---|---|---|---|---|
| CH | 647094 | A5 | * | 12/1984 | 337/333 |
| DE | 19534611 | A1 | * | 3/1996 | H01H/23/20 |
| JP | 2197029 | A | * | 8/1990 | H01H/23/24 |
| JP | 2197030 | A | * | 8/1990 | H01H/23/24 |
| JP | 6-52756 | A | * | 2/1994 | 200/401 |
| JP | 6111688 | A | * | 4/1994 | 200/553 |

* cited by examiner

*Primary Examiner*—Gerald Tolin
*Assistant Examiner*—Anatoly Vortman
(74) *Attorney, Agent, or Firm*—Bacon & Thomas, PLLC

(57) ABSTRACT

A circuit breaker with a push button includes an electrical breaker having a casing having an opening defined therein with a hole defined in each side near the opening. A first prong and a second prong each attached to and extending through the casing. An alloy plate is attached to the first prong and has a free end aligning with the second prong. A seesaw switch is pivotally mounted in the opening of the casing with a shaft extending from the center of each side. Each of the shafts is received in the corresponding hole in the casing. A push block is pivotally attached to the bottom portion of the seesaw switch and has a recess defined therein to receive the free end of the alloy plate. An activation block extends from a top portion of the seesaw switch. A push button is attached to the electrical breaker and has an activation rod movable back and forth therein. The activation rod presses on the activation block of the seesaw switch and has an axis at a right angle with the axis of the shaft.

10 Claims, 3 Drawing Sheets

CIRCUIT BREAKER WITH A PUSH BUTTON

BACKGROUND OF THE INVENTION

1. Field of the Invention

The present invention relates to a circuit breaker for electrical facilities and more particularly to a circuit breaker having a push button that is a reciprocating part.

2. Description of Related Art

Conventional circuit breakers generally employ an alloy plate with on end fixedly connected to a prong and the other end detachably contacting another prong. The alloy plate bends when it is subjected to a high temperature so that when an overload current passes through the alloy plate and a high temperature is generated, it bends and detaches from the contact point of the other prong and cuts the circuit. U.S. Pat. Nos. 5,262,748 and 3,846,729 each has an alloy plate which is indirectly connected to the seesaw switch of the circuit breaker. Each of the allay plates of these two circuit breakers has a potential shortcoming in that they sometimes can't be stably maintained in the closed and opened positions. That is to say, when in the opened position, the alloy plate could contact the contact point of the prong without pressing the seesaw switch. This is because deficiencies exists in the structure between the seesaw switch and the alloy plate so that after the circuit breakers are used for a period of time, indefinite positioning of the alloy plate occurs.

These conventional circuit breakers have several disadvantages.

1. They cannot be mounted on a thick panel. The conventional circuit breaker has two opposite sides each having a clamp to mount the circuit breaker on a panel. Because of limited space, it can only be mounted on a thin panel.

2. Their operation is easily degraded by dust or oil. The casing of the conventional circuit breaker has an opening defined in the top portion to receive the seesaw switch. There is a gap when the seesaw switch is pulled down. Dust and the oil can pass into the casing via the gap to make the circuit breaker have a loose contact.

3. The distance between an operator's finger and the alloy plate is very short when the operator is setting the switch. Sometimes it will give the operator an electrical shock due to static electricity.

4. Easy to inadvertently trip the breaker. The stroke of the seesaw switch is very short so that the breaker can be easily tripped due to a careless touch.

The present invention has arisen to mitigate and/or obviate the disadvantages of the conventional circuit breaker.

SUMMARY OF THE INVENTION

In accordance with one aspect of the present invention, a circuit breaker with a push button includes a conventional electrical breaker having a seesaw switch that has an activation block extending therefrom and a push button attached thereto. The push button includes an activation rod moved to push the activation block of the seesaw switch and to switch the circuit breaker to an opened or a closed position.

Further benefits and advantages of the present invention will become apparent after a careful reading of the detailed description with appropriate reference to the accompanying drawings.

DETAILED DESCRIPTION OF THE INVENTION

Figure 1:
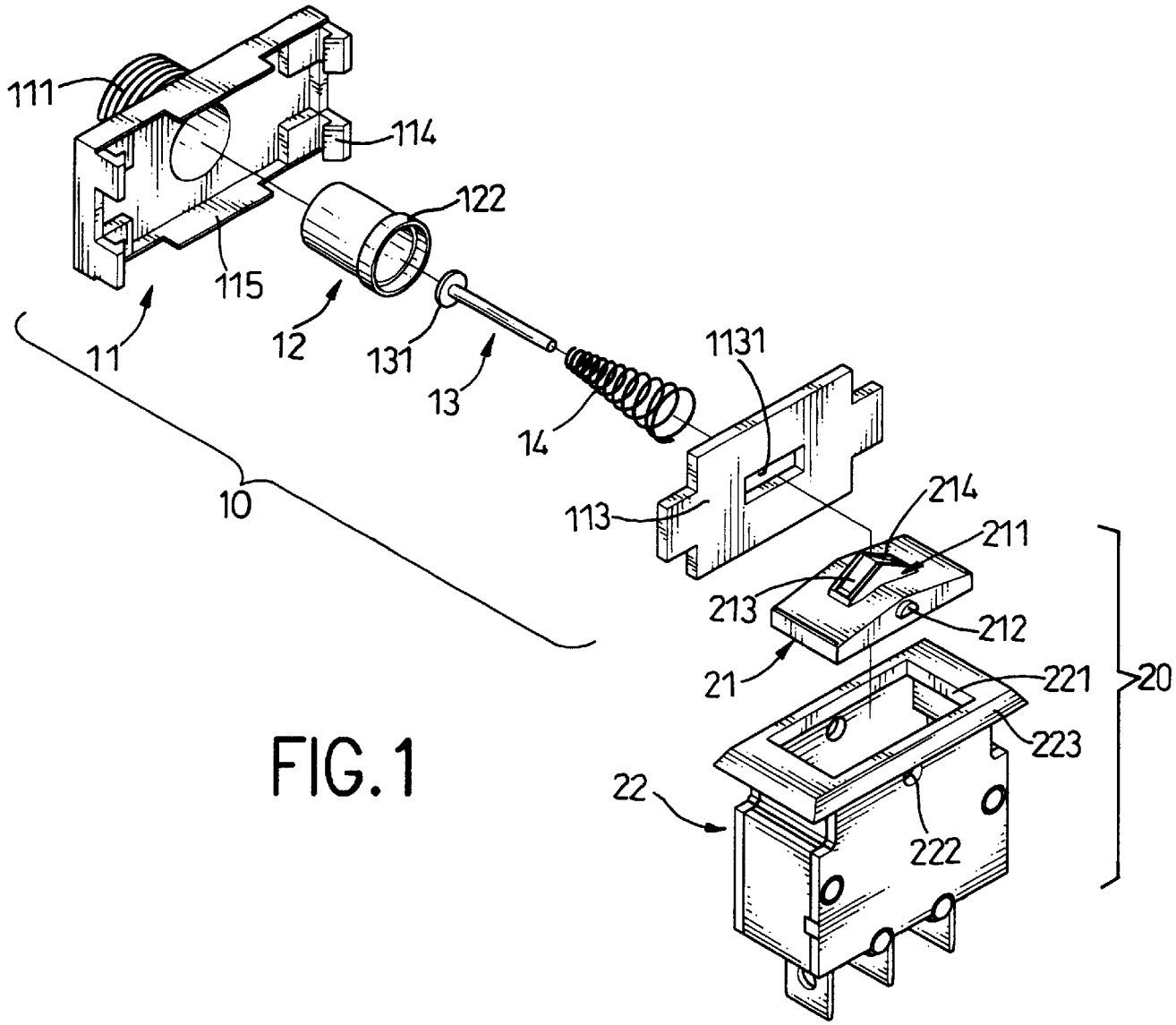
FIG. 1 is an exploded perspective view of a circuit breaker with a push button in accordance with the present invention.
Figure 2:
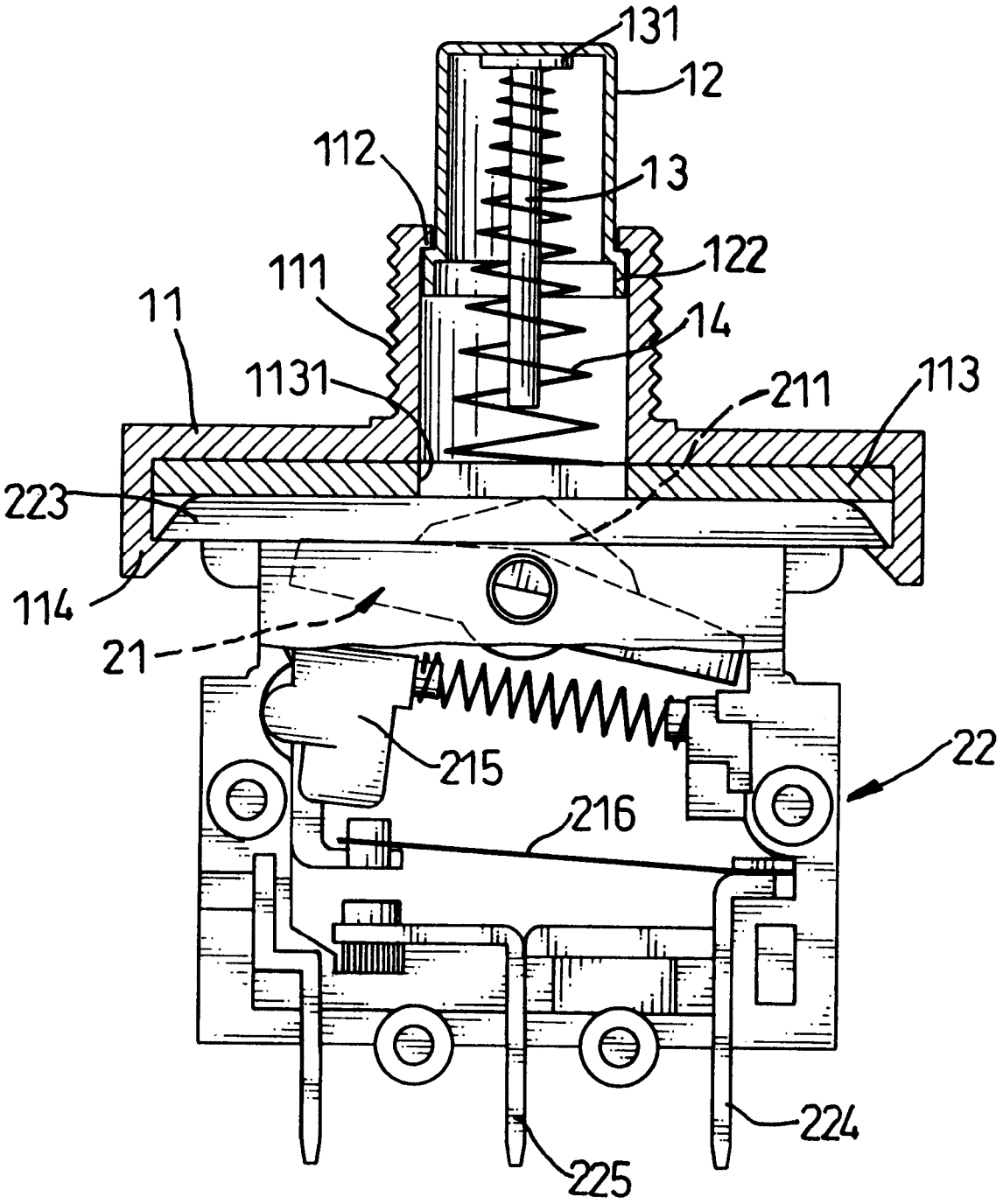
FIG. 2 is a top plan view in partial section of the circuit breaker with a push button in FIG. 1.

Referring to the drawings and initially to FIGS. 1–2, a circuit breaker with a push button in accordance with the present invention comprises an electrical breaker (20) having a seesaw switch (21) and a push button (12).

The electrical circuit breaker (20) includes a casing (22) having an opening (221) to receive the seesaw switch (21). The opening (221) has a first side and a second A hole (222) is defined in each side of the casing (22) near the opening (221). A flange (223) on the casing (22) extends out from the opening. The seesaw switch (21) has a shaft (212) extending from the center of each side. Each of these two shafts (212) is pivotally mounted in the corresponding hole (222) in the casing (22). The seesaw switch (21) includes an activation block (211) extending from the top. The activation block (211) is an isosceles triangle having an open side (214) and a closed side (213). The ridge of the activation block (211) is aligned with the axis of the shaft (212). A push block (215) is pivotally mounted in the bottom portion of the seesaw switch (21) and has a recess defined therein. An alloy plate (216) is attached to a first prong (224). The alloy plate (216) has a free end received in the recess of the push block (215) and be controlled by the push block (215) to detach or contact a second prong (225) to open or close the electrical breaker (20).

The push button assembly (10) includes a clamping seat (11) having four edges, a first side and a second side. The first side of the clamping seat (11) includes a hollow threaded stub (111) upward extending therefrom. The second side of the clamping seat (11) includes multiple hooks (114) extending down from two opposite edges of the clamping seat (11) and at least one stopper (115) extending down from the other edges of the clamping seat (11). The hooks (114) of the clamping seat (11) clamp onto the flange (223) of the casing (22), and the stoppers (115) abut the flange (223) to prevent the clamping seat (11) from slidably detaching from the electrical breaker (20). The threaded stub (111) includes a free end having an internal flange (112) extending radially inward.

A hollow, cylindrical push button (12) with a closed end and an open end with an external shoulder (122) is mounted inside the threaded stub (111). The push button (12) has a diameter smaller than that of the internal flange (112) of the threaded stub (111), and that the diameter of the shoulder (122) is larger than that of the internal flange (112). The closed end of the push button (12) extends out of the threaded stub (111).

An activation rod (13) with a flange (131) is received in the push button (12). The flange (131) of the activation rod

(13) is pressed by the interior of the closed end of the push button (12) to push the open side (214) and the closed side (213) of the activation block (211) of the seesaw switch (21).

A spring (14) is mounted around the activation rod (13) and received in the threaded stub (111) with one end abutting the flange (131) of the activation rod (13).

A fixed plate (113) is attached to the second side of the clamping seat (11) and abuts the exposed end of the spring (14). The fixed plate (113) includes a through hole (1131) defined therein to allow the activation rod (13) to extend therethrough.

Figures 3, 4, 5, 6:
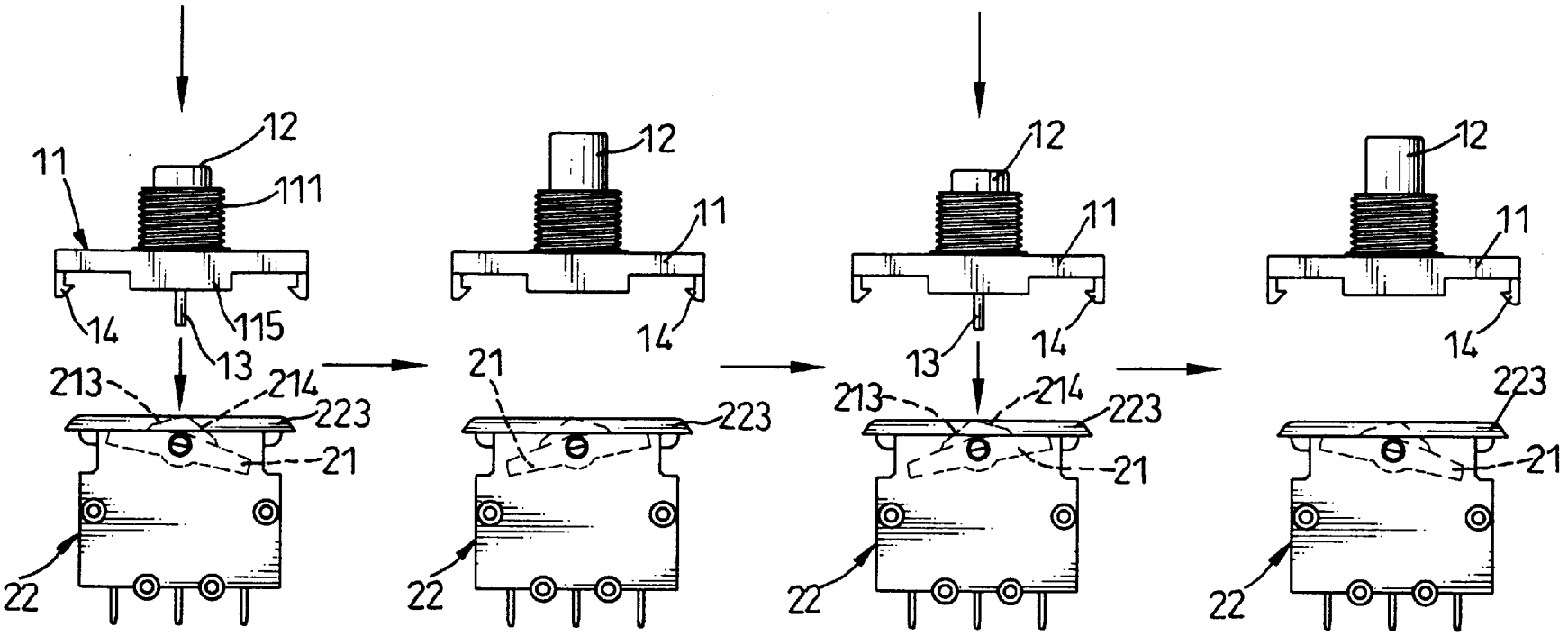
FIG. 3 is a top plan view in partial exploded of the circuit breaker in FIG. 1 when the circuit breaker is in the opened position and the activation rod pushes the closed side of the seesaw switch.
FIG. 4 is a partially exploded top plan view of the circuit breaker in FIG. 1 in the closed position.
FIG. 5 is a partially exploded top plan view of the circuit breaker in FIG. 1 when the circuit breaker is in the closed position and the activation rod pushes the open side of the seesaw switch.
FIG. 6 is a partially exploded front plan view of the circuit breaker in FIG. 1 in the open position.

Referring to FIG. 3, when the electrical circuit breaker (20) is in an open position, the push button (12) is pushed in and the free end of the activation rod (13) presses the closed side (213) of the activation block (211) of the seesaw switch (21). When the push button (12) moves back out by the force of the spring (14), the electrical breaker (20) is closed as shown in FIG. 4.

Referring to FIG. 5, when the electrical circuit breaker (20) is closed, the push button (12) is pushed in and the free end of the activation rod (13) presses the open side (214) of the activation block (211) of the seesaw switch (21). Referring to FIG. 6, when the push button (12) moves back out by the force of the spring (14), the electrical breaker (20) is open.

As described above, the circuit breaker with a push button has several advantages.

1. A locking nut screwed onto the threaded stub is the only thing needed to mount the circuit breaker on a panel that has a wide range of thickness. Consequently, the circuit breaker can be used in a wide range of applications.

2. The push button effectively seals the threaded stub to contaminants. The small gap can effectively prevent the dust and the oil from passing into the electrical breaker via the gap.

3. The threaded stub increases the distance between an operator's finger and the alloy plate thereby preventing the operator from getting an electrical shock from static electricity during operation of the breaker.

Although the invention has been explained in relation to its preferred embodiment, it is to be understood that many other possible modifications and variations can be made without departing from the spirit and scope of the invention as hereinafter claimed.

What is claimed is:

1. A circuit breaker with a push button, the circuit breaker comprising:

an electrical circuit breaker (20) including a casing (22) having an opening (221) defined therein and a hole (222) defined in each side of the casing (22) near the opening (221);

a first prong (224) and a second prong (225) each attached to and extending through said casing (22);

an alloy plate (216) attached to said first prong (224) and having a free end aligning with said second prong (225);

a seesaw switch (21) pivotally mounted in said opening (221) of said casing (22) and a shaft (212) extending from the center of each side of the opening (221), each of said shafts (212) received in the corresponding one of said holes (222) in said casing (22);

a push block (215) pivotally attached in the bottom portion of said seesaw switch (21) and having a recess defined therein to receive said free end of said alloy plate (216);

an activation block (211) extending from the top of said seesaw switch (21); and a push button assembly (10) attached to said electrical circuit breaker (20) and having an activation rod (13) that moves back and forth therein, said activation rod (13) pressing on said activation block (211) of said seesaw switch (21) and having an axis at a right angle with the axis of said shaft (212).

2. The circuit breaker as claimed in claim 1, wherein said activation block (211) includes a closed side (213) and a open side (214) abutting each other, said closed side (213) and said opened side (214) forming a triangle, said triangle having a ridge parallel to said axis of said activation block (211) and aligning with said axis of said activation rod (13).

3. The circuit breaker as claimed in claim 1, wherein said casing (22) of said electrical breaker (20) includes a flange (223) extending out from the edges of said opening (221).

4. The circuit breaker as claimed in claim 3, wherein said push button assembly (10) includes a clamping seat (11) having four edges, a first side and a second side, said first side having a hollow threaded stub (111) extending up therefrom, said second side having multiple hooks (114) extending downward from two opposite edges of said clamping seat (11) and at least one stopper (115) extending down from the other opposite edges of said clamping seat (11), said hooks (114) clamping on said flange (223) of said casing (22) and said stoppers (115) abutting said flange (223) to prevent said clamping seat (11) from slidably detaching from said electrical breaker (20).

5. The circuit breaker as claimed in claim 4, wherein said threaded stub (111) includes a free end having an internal flange (112) extending radially inward.

6. The circuit breaker as claimed in claim 5, wherein said push button assembly (10) includes a push button (12) movable back and forth inside said threaded stub (111), said push button (12) with a closed end extending through said threaded stub (111) and an open end abutting said internal flange (112) of said threaded stub (111).

7. The circuit breaker as claimed in claim 6, wherein said open end of said push button (12) includes an external shoulder (122) extending radially outward, said shoulder (122) having a diameter that is bigger than that of said internal flange (112).

8. The circuit breaker as claimed in claim 4, wherein said activation rod (13) includes one end having a flange (131) extending radially outward and the other end extending downward through said threaded stub (111) to press said activation block (211) of said seesaw switch (21).

9. The circuit breaker as claimed in claim 8, wherein said push button assembly (10) includes a spring (14) around said activation rod (13), said spring (14) having a first end abutting said flange (131) of said activation rod (13) and a second end.

10. The circuit breaker as claimed in claim 9, wherein said push button assembly (10) includes a fixed plate (131) attached to said second side of said clamping seat (11) and abutting said second end of said spring (14), said fixed plate (131) having a through hole (1311) defined near the center to allow said activation rod (13) to penetrate.

* * * * *